United States Patent [19]

Schiffer

[11] 3,936,996

[45] Feb. 10, 1976

[54] METHOD AND APPARATUS FOR PRODUCTION OF FALSE TWIST TEXTURED COMPOSITE YARN

[75] Inventor: Heinz Schiffer, Brussels, Belgium

[73] Assignee: Amcel Europe, S.A., Brussels, Belgium

[22] Filed: Nov. 8, 1973

[21] Appl. No.: 414,087

Related U.S. Application Data

[63] Continuation of Ser. No. 186,785, Oct. 5, 1971, abandoned.

[52] U.S. Cl. ..... 57/34 HS; 57/77.3; 57/104; 57/140 BY; 57/157 TS

[51] Int. Cl.[2] ..... D02G 1/04; D02G 3/04

[58] Field of Search ..... 57/157 TS, 157 MS,93, 94, 57/104, 140 BY, 34 HS, 77.3, 77.45

[56] References Cited

UNITED STATES PATENTS 3,420,049 1/1969 Heberlein ..... 57/157 TS X 3,656,290 4/1972 Kuussaari ..... 57/77.45 X

*Primary Examiner*—Donald O. Woodiel
*Assistant Examiner*—Charles Gorenstein
*Attorney, Agent, or Firm*—Herbert M. Adrian, Jr.

[57] ABSTRACT

A cellulose acetate yarn and a nylon or polyester yarn are independently false twist textured in opposite directions on the same machine using different false twisters to impart to each its optimum level of false twist and the yarns are collected side-by-side on a package. The composite balanced, substantially zero-torque yarn is autoclaved, twisted in the course of coning and circular knit into fabrics with no stripping back of the acetate over the nylon or polyester.

11 Claims, 2 Drawing Figures

METHOD AND APPARATUS FOR PRODUCTION OF FALSE TWIST TEXTURED COMPOSITE YARN

Benefit of Prior Application

Figure 1:
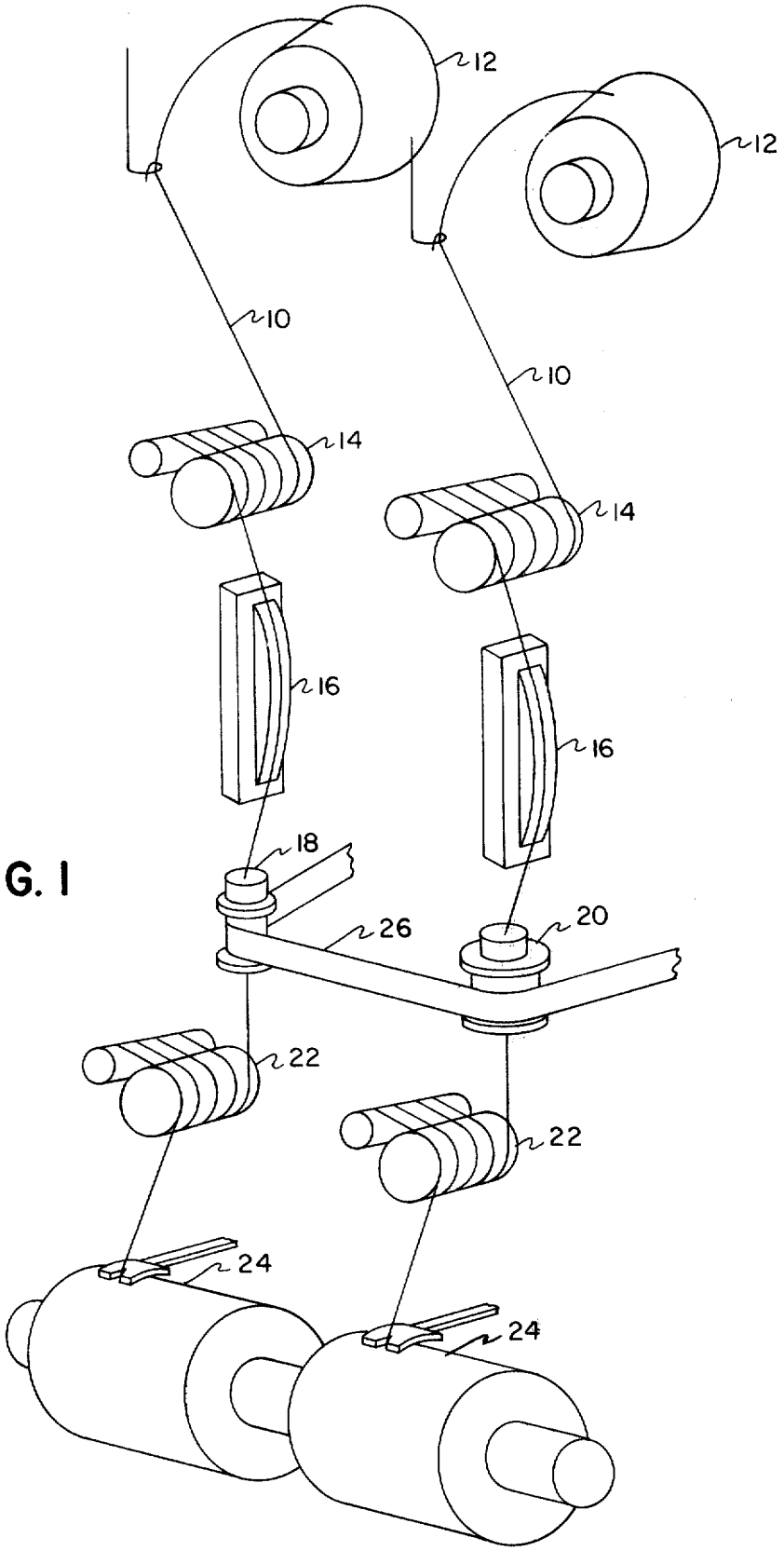

This application is a continuation of application Ser. No. 186,785, filed Oct. 5, 1971, now abandoned.

The present invention relates to producing a joined or composite yarn of balanced torque and comprising an end of false twisted acetate and an end of another false twist textured yarn such as nylon or polyester.

Synthetic thermoplastic yarns have been subjected to false twist texturing to impart to fabrics made therefrom varying degrees of stretch and/or a special hand and appearance. Each yarn so treated will have a different set of characteristics, e.g. cellulose acetate yarns will impart a crisp hand, they are bright and lustrous, dye especially well, etc. Nylon or polyester yarns are stronger and can thus be used to make lightweight fabrics which will perform well. In addition, they are especially fast drying, hold their texture more permanently, etc.

It is obviously desirable for some purposes to combine the advantages of some of these component yarns and this can be done by plying a false twisted yarns of one type with another type of yarn which may or may not also have been textured. Thus to achieve the desirable aesthetic qualities of cellulose triacetate, for example, it has been plied with nylon which imparts strength, and the plied yarn has been textured on a false twisting machine. Unfortunately, however, it has often been found that there is a tendency for the triacetate component to slide over the slippery nylon component and thus form snags or loops, which detract from the appearance of the fabric made therefrom. This tendency is especially pronounced when the yarn makes a sharp angle over a guide, such as is found on many makes of knitting machines. Since knitting is a principal use of such yarns, the problem is especially acute.

It is accordingly an object of the present invention to provide a false twist textured composite yarn made up of two different components and which can be knit or otherwise processed with little or no tendency toward loop formation or slippage of one component over the other.

Another object of the invention is to provide an inexpensive simple process for preparing such yarn.

These and other objects and advantages are realized in accordance with the present invention wherein two different thermoplastic yarns are simultaneously and independently false twist textured, one in S direction and the other in Z direction, thee yarns are joined and then twisted together. Each component yarn or end is textured under its best conditions which will differ for the two components. Advantageously both yarns are false twist textured on a single conventional machine using multiple false twist spindles or bushings which are rotated to impart the desired twist level, i.e. turns per inch. Since the optimum twist levels differ for the components, it is most convenient to utilize a standard multiposition false twist device fitted with a multiplicity of false twisters driven by a common belt. Suitably, yarns of one type will be fed at their best overfeed ratios to spindles or bushings of one size while the second yarns will be supplied independently at their optimum overfeeds to spindles or bushings of a different size. All spindles or bushings will be driven, as customary, off a common drive at a particular surface speed, as by a belt drive. Because of the different sizes, however, the given surface speed will translate into different revolutions per minute, the spindle or bushing sizes being selected to give the desired differential. Preferably, each set of spindles is also mounted to rotate in opposite direction from the other set so that the joinder following false twisting will result in a balanced yarn exhibiting little or no torque.

Figure 2:
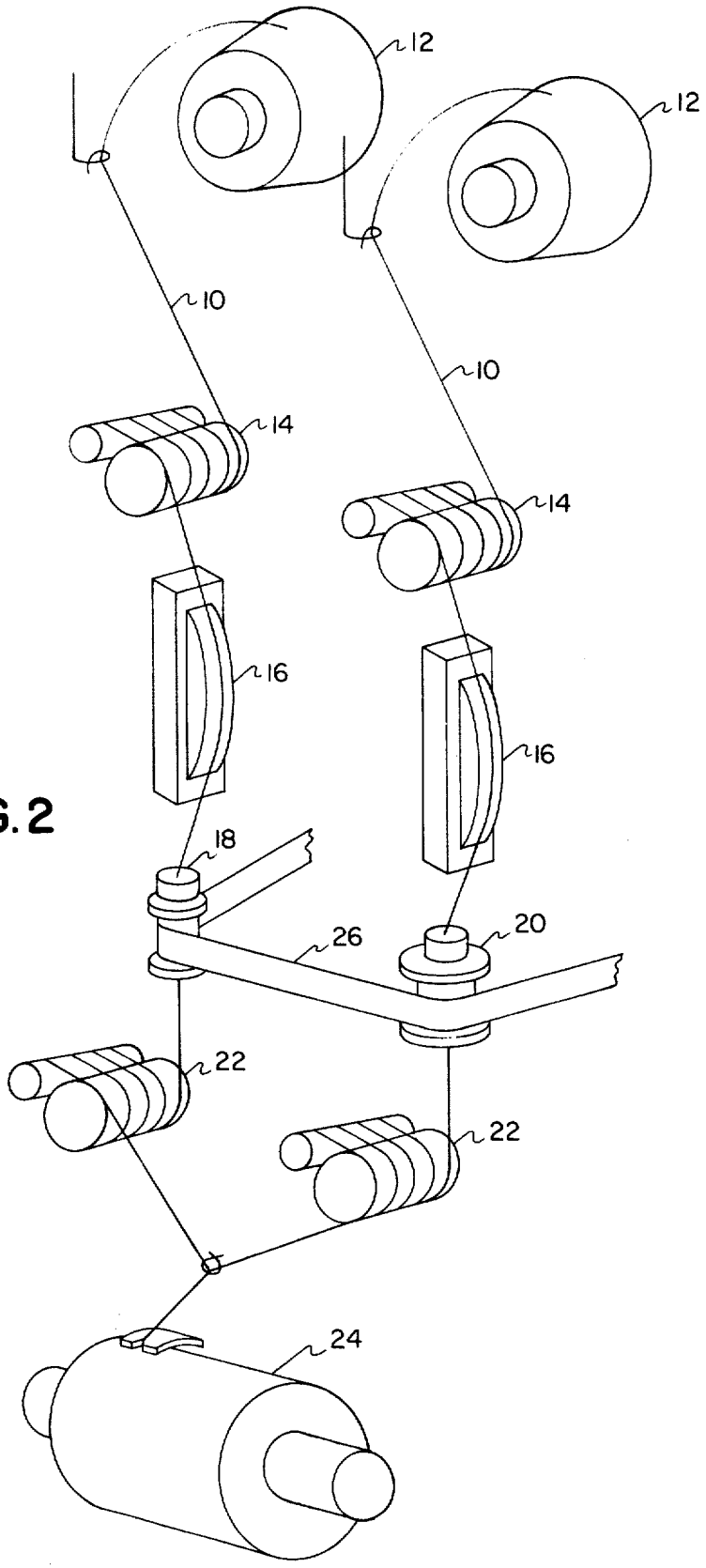

The invention will be more fully described by reference to the drawings in which:

FIGS. 1 and 2 are partial perspective views of the apparatus of the present invention illustrating duel take-up positions and single take-up with duel threadlines.

Referring more particularly to the drawings, yarn 10 is withdrawn from creel 12 by feedrolls 14 and hence across heater plate 16 through false twist spindles 18 and 20 to drawrolls 22 from which the yarn is eventually taken up on a package 24. False twist spindles 18 and 20 are driven by common drive belt 26. False twist spindles 18 and 20 have different drive diameters, thus resulting in different speeds for the spindles being operated off of the common drive belt 26.

In FIG. 2 wherein two yarns are taken up on the same package, the yarns are converged after drawroll 22 prior to take-up on package 24.

Advantageously the composite yarn is collected with a zero-twist take-up, i.e. a collection package rotating about a horizontal axis which adds no twist to the collected yarn. Before or after take-up, the zero twist yarn may be suitably interlaced as in the manner described in U.S. Pat. No. 2,985,995.

The product may thereafter be given a thermal heat setting or stabilizing treatment on the package in an autoclave or such treatment may be carried out on the joined yarns before collection or even on the individual yarns after texturing but before joining. Alternatively, the thermal treatment can be combined wholly or in part with dyeing, being effected in a hot dye bath. Dyeing can be effected either with or without such treatment and the yarn, optionally dyed and/or heat treated, may be twisted in a separate coning operation carried out to produce cones suitable for knitting.

The component yarns may each comprise thermoplastic synthetic polymers such as cellulose acetate, especially triacetate, condensation polymers such as nylon and polyesters, polymers or vinylidene compounds such as olefins, e.g. homopolymers or copolymers or ethylene and/or propylene, vinyl chloride, vinylidene chloride, acrylonitrile, vinylidene cyanide methyl acrylate, and the like. The nylon, i.e. polyamide, is preferably nylon 66 or 6, i.e. polyhexamethylene adipamide or polyaminocaproic acid but units of other dicarboxylic acids, diamines or aminocarboxylic acids can be present in whole or in part. The polyester is preferably polyethylene terephthalate but, here too, units of other glycols or dicarboxylic acids may be included, e.g. butylene glycol, isophthalic acid, etc.

The individual yarns may comprise staple fibers twisted into a bundle or embedded in a carrying structure of continuous filaments but preferably they comprise a continuous filament structure. The individual filament or fiber denier may be as low as 1, or even less, up to 50 or more but advantageously it ranges from about 2 to 25 and preferably about 3 to 15. The yarns may comprise mono-filaments but since they will usually be ultimately plied and mono-filaments are more costly, they each generally comprise bundles of continuous filaments. The number of filaments will depend upon the total denier of each component which will generally range from about 15 to 250; the number of filaments will then generally range from about 2 to 50 and preferably from about 10 to 40.

The filaments making up each yarn are preferably structured relative to one another so that they cannot splay out loosely which could result in snags or snarling with adjacent yarns. To this end they may be lightly bonded to one another, although preferably they are held together mechanically. This can be achieved by imparting twist to the yarn, e.g. less than about 5 turns per inch, or by interlacing the filaments as by pneumatic means. Where an actual twist is utilized, if possible, it is preferred that the false twisting of that component yarn be in direction opposite to that of the yarn's own twist. This tends to open the bundle, allowing the filaments to be acted upon more easily by the heating means which is a part of the false twisting apparatus.

Each yarn, in conventional fashion, will pass from a supply at a given speed into a false twist and heating zone from which it leaves at a different speed. If the leaving speed is 1% faster than the supply speed, the yarn is said to be overfed 1%; if the leaving speed is 1% slower, the yarn is overfed -1%. Each component yarn in accordance with the invention will be supplied at the appropriate speed to result in the optimum overfeed speed since both yarns must leave their false twist and heating zones at the same speed to be collected together. The overfeeds will vary depending upon the composition and structure of the yarn and even when one is positive, the other can be negative. In passing through the false twist zone either on its way to the false twist spindle or bushing each yarn will pass over a heating element while it is in temporarily twisted condition to fix the twist. The heating element may comprise a steam chamber or the like although it is preferably a contact plate heated electrically. The temperature and times of contact may differ for the component yarns although it has been found possible with the preferred yarn structures involved herein to have the temperatures and times the same for both components. This simplifies the procedure for starting and ending an operation since the machine does not have to be modified to permit subsequent normal use without blending; only half the spindles would have to be replaced.

The yarns individually could be given a heat stabilizing treatment by passing over a second contact plate, in known manner, or they can be joined and the composite subjected to a heat stabilizing treatment either before or after being collected on a package. As noted previously, such treatment may be combined with dyeing by utilizing a hot liquid bath containing appropriate dyestuffs or by applying cool liquid containing a coloring agent and placing the wet yarn in an autoclave where heat serves to stabilize the yarn and simultaneously to drive the coloring agent into the fiber.

At times, it may be desirable to employ different yarn texturing processes for each of the composite yarn components for novel yarn effects. In producing hosiery yarns, for example, one particularly successful technique involves cotexturing twin ends of yarn by doubling and introducing a plying twist, passing the plied, doubled yarn through a heating zone to set the twisted configuration in the respective ends, and thereafter separating and untwisting. A representative teaching appears in U.S. Pat. No. 3,091,908. Because the yarn is twisted through a helix of greater radial dimension, cotextured yarns have a generally higher crimp amplitude than spindle textured yarns, but cotexturing processes are unable to handle heavy denier yarns or achieve truly high twist levels. The yarn of this invention can be produced by texturing at least one first and through a false twist spindle to a crimp frequency of at least 40 turns per inch; cotexturing at least one second end; and plying or blending the said ends as by passing through an intermingling jet. The resultant product is a consolidated bulky yarn having intermingled filamentary structures arranged to helical configurations of differing amplitude and frequency. Desirably the respective ends are textured in the opposite sense, i.e. S and Z, respectively, whereby the finished yarn is of balanced or reduced torque. Since the yarn has undergone only a single heat treatment in each case, it is of relatively high stretch, but also exhibits relatively high bulk by virtue of the high crimp amplitude component. It is practicable to utilize as one of the yarn components a heterofil or knife edge type of yarn which develops helical crimp. Thus, a polyethylene terephthalate core/polytetramethylene terephthalate sheath fiber may be combined with a spindle textured fiber to produce a useful yarn of differential crimp amplitude.

In accordance with the preferred aspect of the invention one of the component yarns is multifilament cellulose acetate and the other of said yarns is a nylon, polyester, polyolefin, acrylic or modacrylic yarn, especially nylon or polyester. The total denier of the cellulose acetate yarn, preferably cellulose triacetate, is about 100 to 300 and is about 2 to 6 times that of the nylon or polyester. As a result, the appearance and hand of the yarn will overwhelmingly be those of acetate but, because of the strength, it will be possible to make a lighter weight fabric than if only acetate were present. Moreover, because of the manner in which the yarn is produced compared with plying yarns wholly independently textured, the new yarn is even stronger than ordinarily plied yarns and thus even lighter weight fabrics are possible. In addition, the yarns can be knit at higher speeds and tensions with far fewer interruptions due to breakage or formation of defects due to stripping back.

With these preferred structures the acetate and nylon or polyester subjected to texturing preferably has about 1 to 5 turns per inch of twist or their equivalent, i.e. an equivalent level of interlacing, light bonding, or the like. The temperature of the contact surface over which the yarns pass is about 180° to 190°C. The advantages of these yarns are especially pronounced where the twist level of the nylon or polyester, i.e. its turns per inch during false twisting, is about 1.5 to 2 times that of the acetate.

The invention will be further described in the following illustrative example.

EXAMPLE 1

A. Using a false twist texturing machine identified as A.R.C.T.-FT 415, 150/22/2Z cellulose triacetate is overfed 5% and subjected to 1900 turns per meter of false twist in S direction by using a false twister of a given size. A 30/10 nylon 66 interlaced yarn is overfed 2% and given 2300 turns per meter of Z false twist using a false twister of smaller diameter, both twisters being driven by a common drive belt. Both yarns while false twisted pass over a metal surface at 185°C. upstream of the twisters. The yarns are collected side-by-side without twist and the package is autoclaved for 45 minutes at 130°C. with a vacuum suction before and after this treatment. If desired, at this stage the composite yarn can be dyed, e.g. pressure muff dyeing. The yarn, whether or not dyed, is then twisted to the extent of 2–4 turns per inch in the course of being wound onto cones suitable for circular knitting. The yarns are circular knit into fabrics in conventional manner and the fabrics are characterized by minimal levels of defects due to strip back of the acetate component over the nylon component of the composite yarn. The fabric can be cut and sewn into garments in known fashion. Because of the freedom from torque the yarns process readily and the garments lay flat without twisting and curling. Similar results are obtained when the nylon 6,6 contains 1 to 15% caprolactam, by weight.

B. A similarly useful product is obtained if the nylon yarn of (A) is overfed 14% and is false twisted 4300 turns per meter, which level normally aggravates the problem of strip backs but here poses no problem.

C. Example (A) is repeated but the package is package dyed at 125°C. instead of being autoclaved with the yarn being stabilized during the dyeing treatment.

EXAMPLE 2

Substantially the same results are achieved as in Example 1(A) if there is employed a Sotexa FT-24 machine and its spindles modified as in Example 1 with the sole differences being that the nylon is overfed 20% and is given 3000 turns per meter of Z false twist.

EXAMPLE 3

The process of Example 2 is repeated, replacing the nylon yarn by a 45/20 interlaced polyethylene terephthalate feed yarn. The product processes readily into knit fabrics.

EXAMPLE 4

Using the same machine, temperature and overfeeds as in Examples 2 and 3, 150/40/2Z cellulose triacetate is S false twisted 1900 turns per meter and 68/24 interlaced polyethylene terephthalate is Z false twisted to the same extent; the false twisters are actually different to compensate for the differences in denier of the component yarns. Because of the lower twist level of the polyester yarn and the lower dpf of the triacetate, fabrics knit therefrom exhibit an extremely soft hand.

It will be appreciated that the instant specification and examples are set forth by way of illustration and not limitation, and that various modifications and changes may be made without departing from the spirit and scope of the present invention. For example, one or both the yarn components, where suitable, could be sequentially and/or simultaneously drawn during the texturing operation for example as described in Belgian Pat. No. 728,461.

What is claimed is:

1. A process for simultaneously and independently false twist texturing each yarn member forming pairs of multifilamentary thermoplastic yarns on a single multiposition false twist machine fitted with a multiplicity of twister means associated individually with said multipositions, said process comprising texturing said yarn members of respective pairs of yarns at different twist levels by running each member of said pairs of yarns through individual twister means, said twister means inserting different twist levels as measured in twists per inch and being driven by a common drive belt.

2. The process of claim 1, wherein one member of each of said pairs of multifilamentary thermoplastic yarns is of a different chemical composition from the other member of said pairs.

3. The process of claim 1, wherein one member of each of said pairs is twisted in the S direction and other member is twisted in the Z direction.

4. A process for simultaneously and independently false twist texturing each yarn member forming pairs of multifilamentary thermoplastic yarns, each member of said pair being of a different chemical composition than the other, on a single multiposition false twist machine fitted with a multiplicity of twister means associated individually with said multipositions, said twister means associated individually with said multipositions, said twister means being driven by a common belt, said process comprising texturing said yarn members of respective pairs of yarns at differential twist levels for each of the different chemically composed yarn members, by running each of said member of said pairs of yarns through individual twister means at adjacent texturing stations, the twister members of said individual adjacent twister means having modified belt contacting surfaces constituted by circular cross sections of different diameter.

5. In a false twist texturing machine having multiple yarn false twist texturing positions, each position comprising a yarn feed device, a false twist setting heater and a false twister, with a common drive belt to drive the false twisters, the improvement which comprises false twisters of different circular diameters driven at respective different revolutions per minute by contact with said common drive belt to enable different false twist levels to be inserted into different yarns being processed at the same yarn speed on a single machine.

6. The process which comprises simultaneously and independently falst twist texturing at different turns per inch of twist level insertion on the same false twist machine (1) a plurality of cellulose acetate yarns and (2) a plurality of other yarns selected from the group consisting of nylon, polyester, polyolefin, acrylic and modacrylic yarns; overfeeding to the false twisting devices the cellulose acetate yarns a predetermined amount independently of said other yarns; passing the cellulose acetate yarns to a set of false twisting devices of different diameter than the set of false twisting devices to which said other yarns are passed; driving both sets of false twisting devices by a common drive at the same linear drive speed; false twisting said cellulose acetate yarns and said other yarns one in S direction and the other in Z direction; joining a cellulose acetate yarn with one of said other yarns to form pairs of joined yarns and twisting the joined yarn.

7. The process according to claim 6 wherein the joined yarn is subjected to a thermal stabilizing treatment prior to twisting.

8. The process according to claim 7, wherein the false twisting of both yarns is effected at about 185°C., the total denier of each cellulose acetate yarn is about 100 to 300 and is about 2 to 6 times that of the other yarn, the other yarn being selected from the group consisting of nylon yarns and polyester yarns.

9. The process according to claim 8, wherein the other yarns are false twisted to the extent of about 1.5 to 2 times the number of turns per inch of the cellulose acetate yarn.

10. In a false twist texturing machine having multiple yarn false twist texturing positions, each position comprising a yarn feed device, a false twist setting heater and a false twister, with a common drive belt to drive the false twisters, the improvement which comprises pairs of false twisters, one twister of said pair being of a different belt contacting perimeter than the other, along the machine at adjacent positions, each twister of said pair being driven at respective different revolutions per minute by contact with said common drive belt, to enable different false twist levels to be inserted into different yarns being processed at the same yarn speed on a single machine, and a single wind-up for each pair of false twister positions.

11. The apparatus of claim 10, including means to feed yarn at different speeds to each twister member of a pair of false twisters.

* * * * *